US011118806B2

(12) United States Patent
Yoon

(10) Patent No.: US 11,118,806 B2
(45) Date of Patent: Sep. 14, 2021

(54) LIVING TYPE-MULTIPURPOSE AIR CONTROLLER

(71) Applicant: Dong-Gu Yoon, Seoul (KR)

(72) Inventor: Dong-Gu Yoon, Seoul (KR)

(73) Assignee: STORAGEAN, INC., Seongnam-si (KR)

( * ) Notice: Subject to any disclaimer, the term of this patent is extended or adjusted under 35 U.S.C. 154(b) by 538 days.

(21) Appl. No.: 16/087,367

(22) PCT Filed: Mar. 21, 2016

(86) PCT No.: PCT/KR2016/002819
§ 371 (c)(1),
(2) Date: Sep. 21, 2018

(87) PCT Pub. No.: WO2017/164427
PCT Pub. Date: Sep. 28, 2017

(65) Prior Publication Data

US 2021/0215382 A1 Jul. 15, 2021

(51) Int. Cl.

| | |
|---|---|
| ***F24F 11/80*** | (2018.01) |
| ***F24F 7/007*** | (2006.01) |
| ***F24F 13/30*** | (2006.01) |
| *F24F 130/00* | (2018.01) |
| *F24F 110/10* | (2018.01) |
| *F24F 110/20* | (2018.01) |
| *F24F 13/32* | (2006.01) |

(52) U.S. Cl.
CPC ..... *F24F 11/80* (2018.01); *F24F 7/007* (2013.01); *F24F 13/30* (2013.01); *F24F 13/32* (2013.01); *F24F 2110/10* (2018.01); *F24F 2110/20* (2018.01); *F24F 2130/00* (2018.01)

(58) Field of Classification Search
CPC .. F24F 11/80; F24F 13/30; F24F 13/32; F24F 7/007; F24F 2110/10; F24F 2110/20; F24F 2130/00
See application file for complete search history.

(56) References Cited

U.S. PATENT DOCUMENTS

2006/0199515 A1* 9/2006 Lasko ..... F24F 7/065 454/237

FOREIGN PATENT DOCUMENTS

| | | |
|---|---|---|
| CN | 201078342 | 6/2008 |
| JP | 2008-121579 | 5/2008 |
| JP | 03182181 | 3/2013 |
| JP | 2014-211115 | 11/2014 |
| JP | 2015-117643 | 6/2015 |
| KR | 20-0367849 | 11/2004 |

(Continued)

OTHER PUBLICATIONS

International Search Report for International Application No. PCT/KR2016/002819, dated Dec. 21, 2016.

(Continued)

*Primary Examiner* — Emmanuel E Duke
(74) *Attorney, Agent, or Firm* — Kile Park Reed & Houtteman PLLC

(57) ABSTRACT

The present invention relates to a living-type appliance, and provides a multipurpose air controller which may be used for various purposes according to its use, such as a fan, a fan heater, a laundry drier, a fixing type hair drier, an air shutter and a foot heater used while being horizontally placed on a bottom.

20 Claims, 8 Drawing Sheets

(56) References Cited

FOREIGN PATENT DOCUMENTS

| | | |
|---|---|---|
| KR | 10-2011-0114004 | 10/2011 |
| KR | 10-1102985 | 1/2012 |

OTHER PUBLICATIONS

Chinese Office Action for Chinese Patent Application No. 201680083956.X, dated Dec. 3, 2020.

* cited by examiner

LIVING TYPE-MULTIPURPOSE AIR CONTROLLER

FIELD OF THE INVENTION

The present invention is directed to a multipurpose air controller for living, and more particularly to the integral multipurpose air controller, wherein a heater and a cooling fan are arranged on a symmetry plane and a semicircular wind direction nozzle is arranged in the middle of the symmetry plane, and wherein it might be used as a fan, a fan-heater, a hair drier, a laundry drier, an air shutter or an air cleaner according to a user's purpose of use.

BACKGROUND OF THE INVENTION

In a general configuration of a fan or a fan heater, a direction of wind generated by rotating the fan corresponds to a direction of wind flowing out of the fan or the fan heater. As a way of changing the direction of wind, a header equipped with the fan swings in right/left direction or a wind direction control plate installed at a wind outlet swings in right/left direction with a certain angle range, so that the wind direction may be changed.

Referring to FIG. 1 which shows a different configuration of a fan, a rotating fan is included within a lower part (420), wherein air is introduced through suction holes (200) on a lower part by rotating the fan and wherein air is discharged outside through air discharging channel (260) that is formed along an inner and rear part of a circular or elliptical ventilation duct (140). Here, a wind discharging duct integrated with a main body should be rotated in right/left direction in order to change the wind direction.

In the configuration described above, it is difficult for the fan or the fan heater to change the wind direction upward, while the fan or the fan heater is placed on a floor. Also, air volume from wind pressure generated by a single fan on a side is smaller than air volume from wind pressure generated by dual fans on either side of the present invention.

SUMMARY OF THE INVENTION

The present invention is to solve the above-described problems. A first object of the present invention is to provide a living type-multipurpose air controller, which comprises a single body capable of being equally divided to have five parts in a longitudinal direction, wherein a suction cap fixing handle and a suction cap, which are used for supporting the air controller and for allowing air inflow, are arranged at right/left end, wherein an air filter, a suction fan (or a cooling fan), a heater, a wind direction nozzle drive motor and a control unit are disposed within a circular or polygonal support, wherein a central part is configured in the form of a ventilation duct comprising a power unit and a semicircular wind direction nozzles arranged in double, wherein a temperature/humidity sensor and a wind pressure sensor are arranged between the suction cap and the air filter, and wherein a separate temperature sensor is arranged in the ventilation duct at the center.

In order to use the air controller as the fan, the fan heater, the hair drier, the laundry drier, the air shutter or the air cleaner according to the purpose of use, the user controls air volume of the fan, temperature of the heater, humidity, an angle range of operating the wind direction nozzle, timer setting values, a position of the floor and etc., based on a preset value using mode buttons; otherwise, the user can change a preset value arbitrarily and perform the operation in a reset state.

The second object of the present invention is to provide a living type-multipurpose air controller, wherein the ventilation duct is divided into a power part and a ventilation part by means of a barrier included therein, wherein the semicircular wind direction nozzles are symmetrically arranged within the ventilation duct. The semicircular wind direction nozzle is connected to a position control motor in the polygonal support. Thus, it is possible to control the wind direction nozzle to change a direction of wind direction nozzle or to keep the wind direction nozzle at a stationary position by the user's manipulation of the ROTATE/STOP button. Also, with the manipulation of CROSS/SYNC button, the wind direction nozzles are operated to cross their direction of wind or the wind direction nozzles are operated to be oriented in the same direction.

A third object of the present invention is to provide a function of automatic cleaning and to extend a service life of a heater element by monitoring consumption of overpower above a certain level due to dust in the heating element and the air filter or due to dust staked between electrodes of the heater in an initializing process or during use.

A fourth object of the present invention is to control the semicircular wind direction nozzle and a plate for blocking wind pressure, which can discharge air at a maximum angle while the wind direction nozzles are rotating, if the air controllers are disposed in parallel.

At a position where the semicircular wind direction nozzle moves to the innermost limit, the plate for blocking wind pressure is provided, which corresponds to each wind direction nozzle. According to the user's setting, the control unit performs the function of automatic cleaning for the air filter at the initializing process or the function of blocking wind pressure only in a vertical direction of the main body during the normal operation, so that wind in a horizontal direction at a side is prevented from being changed in its wind direction by wind in a vertical direction at the other side, if the air controllers are arranged in parallel. At the same time, wind blowing on a lateral side increases in its wind strength a little more.

Each plate for blocking wind direction is connected to a position control motor, which is positioned opposite to a drive motor for wind direction nozzle. According to the user's setting, the plate for blocking wind determines whether it blocks inlet of the wind direction nozzle in a complete manner while the wind direction nozzle moves inward entirely or it opens the inlet in complete manner. Otherwise, the plate determines what position it is disposed and what percent of wind moves toward the wind direction nozzle.

The multipurpose air controllers adjacently positioned to each other share information about positions of the wind direction nozzle and the plate for blocking the wind direction nozzle. Thereby, the semicircular wind nozzles do not operate individually, but they operate in a consistent manner.

A fifth object of the claimed invention is to provide a polygonal support suitable for using the living type-multipurpose air controller of the present invention on the floor, wherein wind flow is controlled according to a position of the polygonal support using the semicircular wind direction nozzle.

An inner diameter of the polygonal support, in which the air filter, the suction fan, the heater and the wind direction nozzle drive motor and the control unit are disposed, is designed to be larger than a height defined by inserting a power plug in the form of a right angle into a power inlet disposed on a rear surface of the central ventilation duct, and thus, inclined sides are maintained even when the air controller is placed on the floor with the inclined sides of various angles in the polygonal support. Based on the detection of the position senor in the control unit, the wind direction nozzle disposed near the floor operates within a range that does not exceed a determined maximum temperature range; otherwise, the wind direction nozzle moves inward and then the plate for blocking the wind direction nozzle blocks the outlet of the wind direction nozzle, to thereby prevent wind discharge.

A sixth object of the present invention is to the living type-multipurpose air controller having a safe configuration as well as safeness in operation.

In other words, the fan serving as a driver is protected against approach to the fan blade by means of the suction cap. However, even when a child inserts an thin and long rod like a chopstick into an air inlet, air-permeable sponge attached to an inside of the suction hole and the air filter at an inlet of the fan prevent the rod from contacting the fan blade. Further, if a child blocks the suction holes on the suction cap and rapid change in wind pressure is detected while volume of wind is not adjusted by means of mode setting, it is possible to generate alarm sound using a buzzer in the control unit and to reduce rotation speed of the fan. If the heater is an on-state, it is also possible to interrupt the operation of the heater at the same.

In a conventional heating appliance employing a PTC (Positive Temperature Coefficient) heating element, a heat sink in the form of a corrugated tube serves as an electrode, there is a risk of electric shock when an object like a chopstick contacts the heat think through meshes of a protecting net. In the present invention, however, two semicircular wind direction nozzles are disposed with the interval of about 0.5 mm, so that there is little or no gap when viewing from the outside. Also, since the semicircular wind direction nozzle is used, introduction of foreign materials is blocked. Additionally, even if foreign material is introduced through the discharging outlet of the wind direction nozzle in operation, there is not any PTC heating element which could contact the foreign material behind the discharging outlet. Accordingly, it is possible to provide a safer design configuration.

Further, in the living type multipurpose air controller of the present invention, the rectangular ventilation duct has dual structure, wherein warm or hot air passing the heater is discharged toward the wind direction nozzle through an inner duct of the ventilation duct, whereas cool wind passing the outside of the heater is discharged toward separate exhaust holes through an outer duct of the ventilation duct, which is formed by separating the outer part of the ventilation duct by a barrier.

Accordingly, the user would not be burned, even when he touches the body of the ventilation duct while using the heater. Notwithstanding, a part of the ventilation duct adjacent to the wind direction nozzle may have the higher temperature that the other part of the ventilation duct in connection with its structure. Thus, it is visually exposed to the user to send warning. Specifically, a temperature tape is attached or temperature-sensitive paint is printed along a circumference of the ventilation duct at a position that is apart from right/left side of the ventilation duct by ⅓ length, so that the user may recognize the hottest part by confirming a color similar to red in consideration of the color change in the temperature tape or the pain. Of course, the LCD in the control unit displays the temperatures of three parts one after another according to air flow, wherein the inner temperature of the suction cap (the temperature of suction air), the inner temperature of the ventilation duct (the temperature of the discharge air) and the temperature of the ventilation duct at the inlet of the wind direction nozzle are repeatedly displayed thereon in the order.

If the user wishes to view any one of three temperatures on the LCD, the user has to wait until the corresponding temperature is displayed on the LCD and the user has to approach the LCD so as to confirm the temperature indicated by numerals and letters. However, means for color-displaying of the temperature, which is based on the temperature tape, may be more useful, because it is possible to recognize the temperature without any delay, although exact temperature value cannot be displayed.

A suction cap fixing hole and a suction cap fixing handle for fixing the suction cap are provided at a central end of the suction cap, wherein said handle serves as a fan grill which protects the user by preventing the user's hand from directly touching fan blades of the cooling fan. Additionally, an air filter receiving groove is provided. Accordingly, the handle projects in the vicinity of tetragonal suction cap/filter support secured to the cooling fan fixing hole and the handle is fixed through a fixing hole of integrated parts at a fixture entrance of suction cap. Thereby, the suction cap is coupled to a polygonal support.

A seventh object of the present invention is to provide a living type-multipurpose air controller which includes a separate prop formed with air suction holes, so that the air controller may be used in a vertical direction by being disposed on the prop. In such a case, the position sensor in the control unit can recognize the state of the air controller. If it is determined that a preset position of the bottom is different from a current position of the bottom, the air controller is regarded as being collapsed, so that the heating operation of the heater is interrupted or the driving of the fan is stopped. Additionally, all the wind direction nozzles are positioned in a state of being withdrawn and the plate of blocking the wind direction nozzle covers inlets of the wind direction nozzles according to the preset program. The last object of the present invention is to provide various cradles for improving convenience of the living-type multipurpose air controller.

Left/right sides of the cradle in the 'A' form are inserted between the suction cap and the suction cap fixing handle to thereby fix the suction cap fixing handle, so that it is possible to stabilize the placement of the air controller by means of narrow horizontal plane in the polygonal cap.

The dedicated cradle in the 'A' form has a cradling projection in the form of telescopic antenna, which can be pulled out, at its upper part. Accordingly, it is possible to place or remove a certain number of the living type-multipurpose air controller in right/left direction.

Also, it is not only possible to dispose the cradle in the 'H' form in the horizontal direction, but also possible to dispose the same in the vertical direction. Further, it is possible to provide rotating means at a center of the cradle in the 'H' form, so that the living type-multipurpose air controllers cradled in plural can be rotated in a limited range.

SUMMARY OF THE INVENTION

In order to achieve the above-described objects, the living type-multipurpose of the present invention comprises: a cooling fan; a drive motor arranged adjacent to said cooling fan; and a ventilation duct including a semi-circular wind direction nozzle, wherein air inhaled by said cooling fan is discharged along a right-angled path through the semicircular wind direction nozzle connected to a drive shaft of said drive motor.

It further comprises a heating element arranged side by side with said drive motor.

It further comprises at least one or more circular or polygonal support, which includes said cooling fan and said drive motor therein.

Said polygonal support comprises: a senor unit including a temperature sensor, a humidity sensor, a position sensor, a wind pressure sensor, etc.; an input switch unit including a power switch and a limit switch; a display including an LCD, LED and a buzzer; a control signal unit including an on/off signal of the motor, the cooling fan and the power; and a control unit including a microcontroller connected to said sensor unit, said input switch unit, said display and said control signal unit.

Said control unit performs operation in connection with ambient temperature, humidity, air volume of wind from the cooling fan, temperature of a heater, temperature inside the ventilation duct, an operational angle range of the wind direction nozzle, a timer setting value, a floor position, organized operation with an adjacent device, etc., based on a preset value or said control unit allows said operation based on a reset-value that is arbitrarily changed by a user.

Said ventilation duct has a bracket at its end and wherein a body of the drive motor is fixed to the bracket, so that the drive motor is coupled to the ventilation duct.

Said bracket is connected to a rotation axis included in an end of the semi-circular wind direction nozzle, and wherein a limit switch is fixed to the bracket in correspondence with a position sensing bump, which projects at a location away from a center axis of the said semi-circular wind direction nozzle.

Said ventilation duct has an outer skin, which includes a structure of double barriers, and wherein wind flow generated from the outside of said cooling fan at room temperature is introduced between the double barriers.

Said ventilation duct is formed with air vents in order to discharge wind flow which was introduced between the double barriers.

Said ventilation duct has at least one or more wind direction nozzles and wherein the wind direction nozzles are crossed with each other to operate in the CROSS manner or the wind direction nozzles operates in the SYNC manner without crossing with each other Said ventilation duct comprise a cover plate for wind direction nozzles, so that air suction inlets of the wind direction nozzle are covered with the cover plate when the wind direction nozzle rotates inward to the maximum.

Said cover plate for wind direction nozzles has a rotation axis which is connected to a bracket installed at right/left end of the ventilation duct and wherein said rotation axis of the wind direction nozzle is driven by a motor included at an end of the ventilation duct, so that said air suction inlets of the wind direction nozzle is adjusted to a position with a constant interval.

Said polygonal support is used while an arbitrary external surface of said polygonal support lies on a bottom floor.

If an arbitrary surface of said polygonal support lies on the floor, a position sensor of said control unit senses a direction of said wind direction nozzles from a placement angle of said polygonal support, and wherein if it is determined that the wind direction nozzles faces the floor, such state is displayed on a display and the corresponding wind direction nozzle moves inward and is covered with the cover plate for the wind direction nozzle so as to prevent wind discharge or said cooling fan or said heater is maintained in a stationary condition, so that a safe state is maintained.

Said polygonal support is prevented from directly contacting the floor so as to avoid damage, and wherein said polygonal support has a circular rubber band tightly fitted around its periphery so as not to allow said polygonal support to slip on the floor, to thereby form a rubber-foot on said polygonal support.

Said multipurpose air controller includes at least one or more cooling fans at an end of the ventilation duct.

Said multipurpose air controller includes at least one or more air filters outside of said cooling fans.

Said multipurpose air controller further includes a suction cap/filter support, which serves to receive and support said air filters and which is formed with a suction cap fixing hole for fixing the suction cap.

Said suction cap further includes suction holes for allowing flow of external air, in addition to the suction cap fixing hole.

Said suction cap is prevented from being separated by fixing a suction cap fixing handle or a camera module to the suction cap/filter support.

Said multipurpose air controller is formed with a separate fixing hole for a multipurpose prop between the suction cap and the suction cap fixing hole, to enable co-fixing.

Said prop is formed with separate suction holes for allowing ambient air to flow into the suction hole of said suction cap.

Said prop includes a fixing means for fixing at least one or more multipurpose air controller.

Said control unit further comprises a wireless input/output part.

Said control unit controls a direction change between the wind direction nozzles of the adjacent multipurpose air controllers so as to attain mutual synchronization.

If said control unit detects that at least one or more multipurpose air controllers are included on a prop and if two semicircular wind direction nozzles are set to operate in the CROSS manner, the wind direction nozzle that has been moved inward is covered with the cover plate of the wind direction nozzle and only the projected wind direction nozzles of the adjacent multipurpose air controllers enable wind blowing, so that wind blows in the direction that is determined according to a vector principle.

Said heating element is such that a heat sink integrated with electrode is coupled to a PTC heating device.

Said heating element comprises a ceramic heating element formed with hexagonal fine pores for ventilation.

Said heating element comprises coils which are wound in a circular shape.

Said ventilation duct includes a power unit at an end opposite to an opening on which the wind direction nozzle is arranged, and wherein said ventilation duct includes slots for installing a barrier or a barrier for separating a space for the power unit and a space for the opening for the wind direction nozzle.

A separation plate guided along said slots for installing the barrier is inclined in its middle, so that most of wind generated from the cooling fan is guided toward the ventilation duct to thereby increase wind pressure.

Wind generated from a blade end of the cooling fan flows through a small space between said separation plate and said ventilation duct.

Ventilation grooves for discharging air are arranged on an outer wall opposite to the opening of the ventilation duct which is separated by the separation plate forming said barrier.

Said semicircular wind direction nozzle is formed by coupling unitary semicircular wind direction nozzles which is capable of separating/coupling.

Said multipurpose air controller is such that the length of said ventilation duct increases or decreases in proportion to the number of coupling said unitary semicircular wind direction nozzles.

The cooling fan, the drive motor and the heating element are included on at least one or more side.

If the control unit senses the power switch's turning-on and if an automatic cleaning mode is selected when turning on the power unit, the control unit controls the semicircular wind direction nozzles at either end of said ventilation duct to move inward to thereby cover the ventilation holes of the semicircular wind nozzles by means of the cover plate for wind direction nozzle, and then the control unit controls the cooling fan to be driven for a certain period of time so as to expel to the outside dusts on the heater, the drive motor, the cooling fan and the air filter positioned at an end, until the control unit controls the cooling fan to stop the operation and wherein the control unit controls the cooling fan positioned at opposite end to be driven for a certain period of time to thereby expel dusts on the heater, the drive motor, the cooling fan and the air filter at the other end, so that automatic cleaning operation is achieved.

Said multipurpose air controller is such that if the state of consuming overpower above a certain level is sensed during a normal operation after initializing operation, the normal operation is interrupted so as to perform the automatic cleaning operation and thereafter the normal operation is re-started.

Said multipurpose air controller is such that after the automatic cleaning operation is performed, at least one or more ventilation holes of the semicircular wind direction nozzle covered is separated from the cover plate for the wind direction nozzle, and then the cooling fan in an interrupted state begins its operation, so that the automatic cleaning mode is changed to the normal operation mode.

Said ventilation duct has at least one or more means for indicating color change according to temperature change at its outside.

Said semicircular wind direction nozzle has at least one or more means for indicating color change according to temperature change at its outside.

If said heating element is a PTC heater comprising the heat sink serving as the electrode which is coupled to both faces of each of a plurality of PTC devices, warming-up is performed by rotationally applying drive voltage to each electrode with a certain time interval, according to the order of arranging PTC devices.

If said heating element is a PTC heater comprising the heat sink serving as the electrode which is coupled to both faces of each of a plurality of PTC devices, a lower voltage is applied to each electrode, on which the PTC device is arranged, during a step of warming-up operation, whereas a normal voltage is applied to each electrode after the step of warming-up operation.

If said heating element is a PTC heater comprising the heat sink serving as the electrode which is coupled to both faces of each of a plurality of PTC devices and if drive voltage applied to each electrode on which the PTC device is disposed is ON/OFF controlled in the PWM manner, a period of applying voltage to the PTC device extends for a short time during a step of warming-up operation, whereas a period of applying voltage to the PTC device extends for a long time.

If said heating element is a PTC heater comprising the heat sink serving as the electrode which is coupled to both faces of each of a plurality of PTC devices, ways of controlling voltages applied to each electrode on which the PTC device is disposed are mixed for operation.

It further comprises an external sensor system comprising at least one or more wireless interface modules.

Said external sensor system comprises a temperature sensor, a humidity sensor and/or air quality sensor.

The user's position oriented operation is achieved by means of a sensor detected from a position where said external sensor system is positioned.

The camera module rotates in a left/right direction by the camera drive motor control of the control unit on the basis of a camera control position input value that is externally inputted.

Advantages of the Invention

In the living type-multipurpose air controller of the present invention, wind generated by the cooling fan fixed in the polygonal support passes the heating element and flows into the ventilation duct leading to a narrow space width. Then, wind flowing into the ventilation duct is discharged outward through the air discharging duct included in the semicircular wind direction nozzle by means of wind pressure.

Here, according to the control of the heating element, the living type-multipurpose air controller serves as the conventional fan or the fan heater.

It may be used as a laundry drier by placing the polygonal support on the floor under a clothes horse, while having the wind direction nozzle to face upward. Otherwise, it may be used as a fixed hair dryer when it is horizontally installed at an upper end of a mirror.

It may be used as an air shutter by mounting to an upper part of a door or an entrance. Otherwise, it may be suspended from a ceiling using fixing means like a fluorescent lamp, without any further construction.

It may be used as a standing type-fan or fan heater by placing the living type multipurpose air controller on a separate prop formed with air suction holes.

In the suction cap, an air filter is included within a suction cap/filter support which is positioned over the cooling fan secured the polygonal support, so that it is possible to use the living type-multipurpose air controller as an air cleaner. In other words, when it is used as a fixed hair drier requiring large volume of air, the filter that can filter only coarse dust and absorb large air flow is used. However, if it is needed to improve the capability of the air cleaner, a high-density filter for screening fine dust is employed for use.

A reflection tape enabling the control unit to identify a type of the filter is provided at a side surface of the filter mounted to the suction cap/filter support. According to a type of the filter, if it is determined that a common filter is used, the control unit sets a flag for performing automatic filter cleaning operation whenever power turns on; otherwise, the control unit can maintain a release state (in case of the high density filter). The user can change such a setting state on the LCD, so that whether or not the automatic cleaning function is performed is determined whenever power turns on.

Also, the living type-multipurpose air controller allows an individual air controller to be integrated with each other by means of sliding grooves formed in the polygonal support. However, more air controllers are mounted in many directions using various kinds of separate cradles dedicated to the air controller.

Particularly, it is installed at an upper end of an entrance door with the wind direction nozzle facing downward, so that it can be used as an air shutter which blocks inflow of cold air from outside whenever the entrance door opens.

Accordingly, the living type-multipurpose air controller of the present invention has a safe configuration that the cooling fan or the heating element is not exposed. Also, the living type-multipurpose air controller of the present invention may be used as the fan, the fan heater, the laundry drier, the air cleaner, the hair dryer and the air shutter according to a purpose of use or site.

DETAILED DESCRIPTION OF THE INVENTION

Herein-below, a living-type multipurpose air controller (referred to as "a multipurpose air controller") according to a preferred embodiment of the present invention will be described with reference to the drawings.

Figure 1:
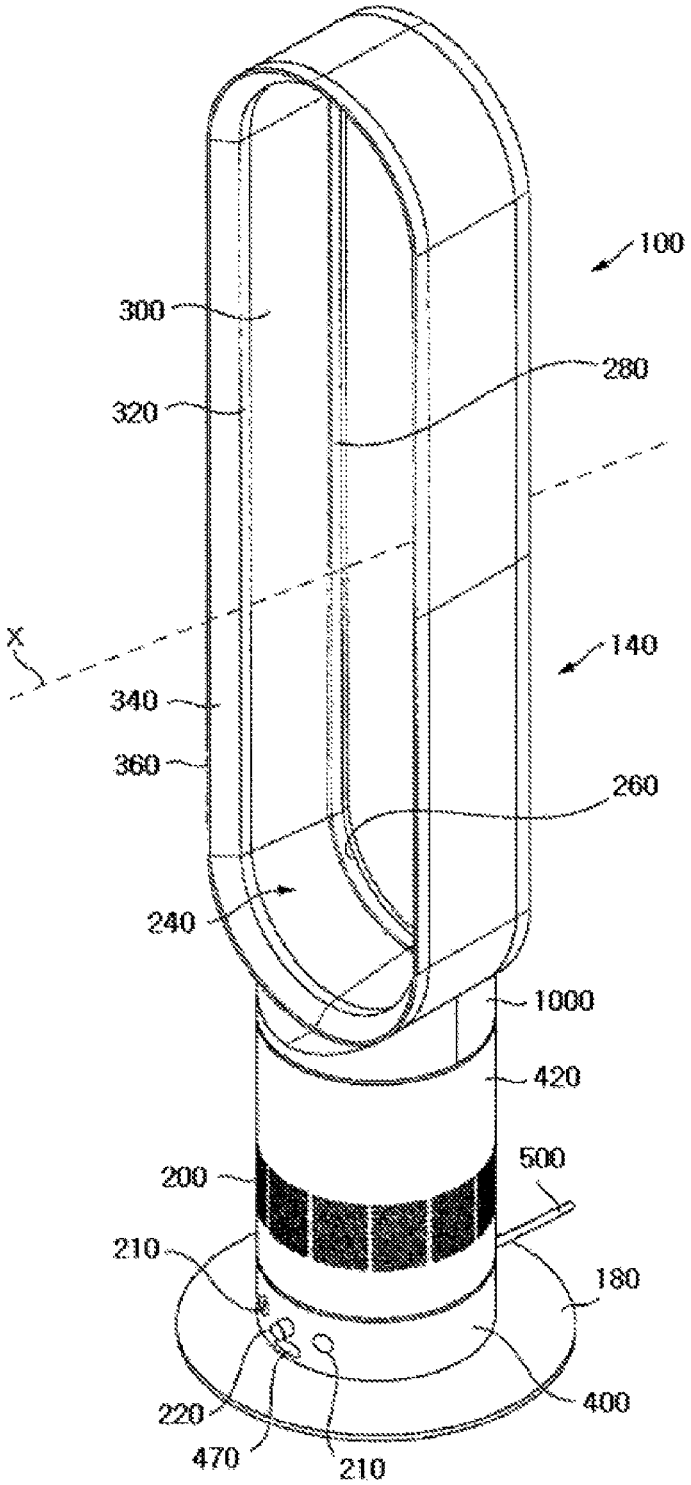
FIG. 1 is a perspective view of a tower-type fan according to the prior art.
Figure 2A:
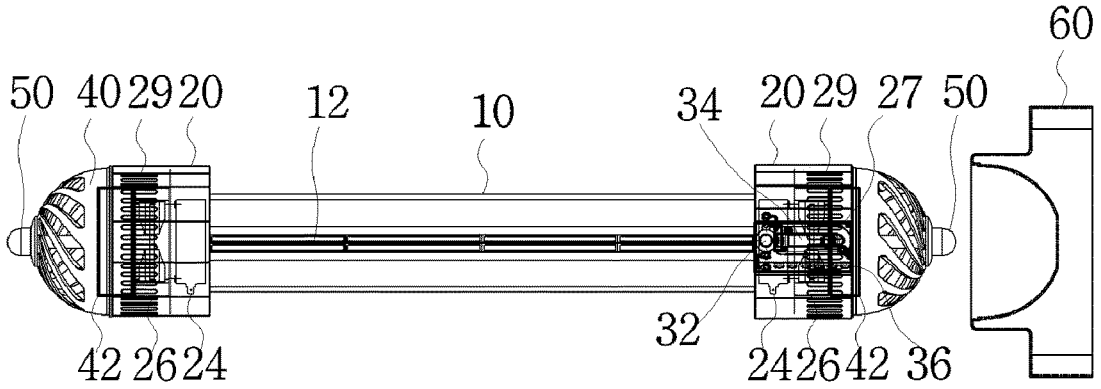
FIG. 2A is a front view of a multipurpose air controller according to the present invention.

As shown in FIG. 2A, the multipurpose air controller (1) has a body comprising a ventilation duct (10), a circular or polygonal support (20), a suction cap (40) and a suction cap fixing handle (50) for fixing sad suction cap (40).

When viewing from outside, the ventilation duct (10) has two semicircular wind-direction nozzles (12) therein and has circular or polygonal supports (20) coupled to right/left ends of the duct. By means of cooling fans (26) enclosed within the circular or polygonal support (20) at right/left ends, air is introduced into the ventilation duct (10) and is discharged outside through the semicircular wind-direction nozzles (12).

Although the multipurpose air controller of the present invention might be used while an arbitrary surface of the polygonal support (20) forming the body lies on a floor, a separate prop (60) coupled to the suction cap (40) is also used, wherein the prop (60) is fixed by the suction cap fixing handle (50) and the prop (50) is used in an upright position. FIG. 2A shows only a prop (60) at an end, but the other prop (60) might be provided at an opposite end so as to allow the air controller to be used in a horizontal position. In such a case, a side of the tetragonal prop (60) lies on the floor at the right/left end, so that a center axis of the air controller (1) is positioned at a level of a center axis of the prop (60). Accordingly, the air controller (1) may be used while it rotates on the props (60).

If the prop (60) is not used and the multipurpose air controller (1) is used while the body lies on the floor, the polygonal support (20) is apt to slide, so that there is risk of scratches on a surface which is in contact with the floor.

In order to solve this problem, a circular rubber band (not shown) is tightly provided around the polygonal support (20) so as to form a so-called Rubber-Foot. Accordingly, it serves to protect a contact surface of the polygonal support (20). Also, the rubber band (not shown) may include various colors, so that it is possible to enhance the completeness of design.

Figure 2B:
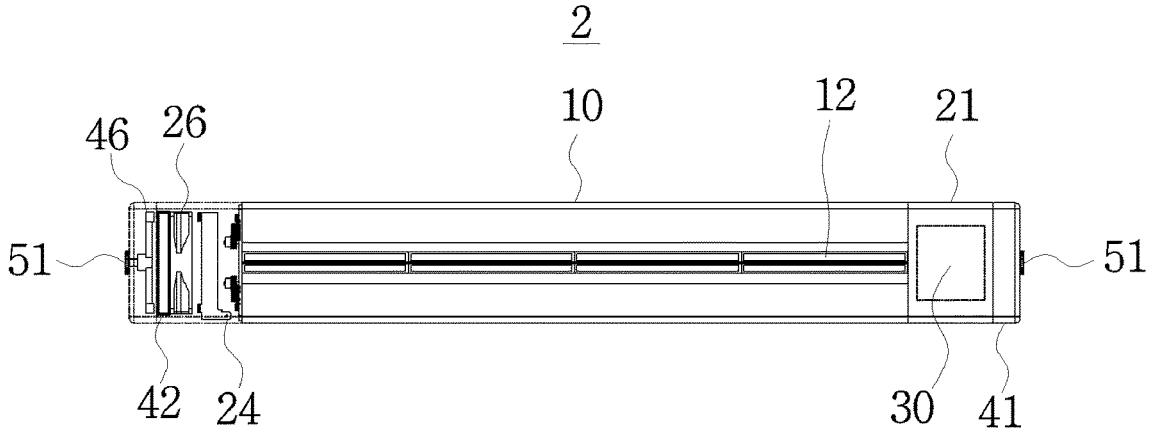
FIG. 2B is a front view of another multipurpose air controller according to the present invention.

FIG. 2B shows a multipurpose air controller (2) formed with different configurations at its left end and right end, wherein the arrangement of major parts, such as a heater (24), a cooling fan (26) and an air filter (41) received in a larger circular or polygonal support (20) of FIG. 2A is the same as that in FIG. 2B. However, the circular or polygonal support (20) of the multipurpose air controller (1) in FIG. 2A has an outer diameter serving to receive the major parts, which is lager than that of the tetragonal support (21) in FIG. 2B, so that the multipurpose air controller (1) of FIG. 2A may include the larger heater (24), the larger cooling fan (26) and the larger air filter (42) to thereby enhance wind pressure/air volume of wind and air filtering capability.

Also, a control board (27) is provided at a side of the circular or polygonal support (20), wherein the control board comprises a power on/off switch (32), an LCD (34) for monitoring operation and setting states and a control switch (36). Also, it comprises a temperature/humidity sensor (not shown) for monitoring temperature and humidity of an ambient air.

There is provided an array of suction hole (29) around the outside of the circular or polygonal support (20), so that it is possible to increase air volume flowing from a suction hole (44) formed on a suction cap (40).

A filter and suction cap support (46-1) is fixed together with the cooling fan (26) through a fixing hole of the cooling fan (26). The filter and suction cap support has thin and long-plastic ribs therein and is formed with a space for receiving air filter (42) at its outside, so that the air filter (42) can be mounted. Also, the suction cap (40) may be readily assembled or disassembled in such a manner that a suction cap fixing handle (40) is rotationally locked or unlocked in a suction cap fixing hole formed at a center support.

The tetragonal support (21) in FIG. 2B has the smaller area for receiving the control board (27) than the circular or polygonal support (20) in FIG. 2A, and thus, the LCD is removed there-from. Instead, an operation and state display (30) is provided.

Figure 3:
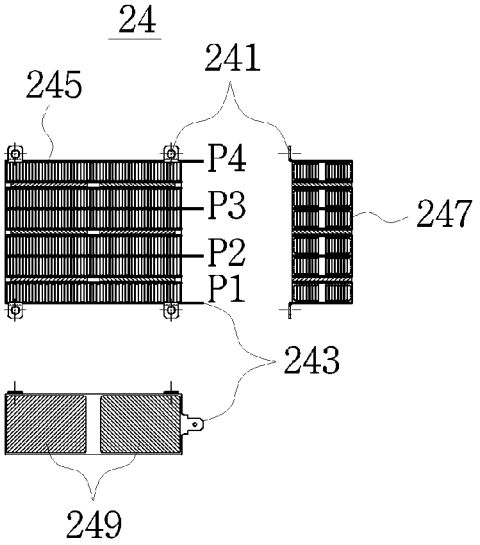
FIG. 3 are a plane view and a side view of the PTC heating elements serving as heating means, which are employed in the embodiment of the present invention.

FIG. 3 shows a plane view and a side view of a PTC heating device which is an example of a heater or heating means (24) used in the present invention.

The PTC heater (24) is fitted to a second bracket (28) through four fixing holes (241) at corners, wherein the second bracket (28) is provided to the polygonal support (20) or the tetragonal support (21).

The PTC devices (249), each of which is a heating device, are assembled by means of a unit heat sink (245) of a corrugated plate fixing type using electrically conductive adhesive (not shown) as shown in the plane view of FIG. 3. Here, a power terminals (243), each of which projects from the unit heat sink (245) of the corrugated plate fixing type, are coupled to power terminals (not shown) of a power source board (15) through a separate wire harness (not shown).

As a way of applying electric power to the PTC devices (249) arranged, the power terminals (243) denoted with P1, P2, P3 and P4 are connected to the control board, wherein P1 and P3 having the same polarity are connected to the control board through the wire harness (not shown) and wherein P2 and P4 having the same polarity are connected to the control board.

As shown in right side view of FIG. 3, the unitary heat sink (245) of the corrugated plate fixing type is formed with cooling bumps (247), each of which has a dimple, at a side of the corrugated plate in order to increase heat sinking characteristic in connection with air flow.

With reference to FIG. 3, the heater means (24) comprising the PTC heating devices and the heat sink plate used as an electrode are described as an embodiment. However, in the other embodiment, it is possible to envisage a ceramic heating device in a honeycomb configuration which has hexagonal holes. Simply, it is possible to envisage a round type-heating device, which is formed by winding heating coils in the shape of spring coil.

Figure 4:
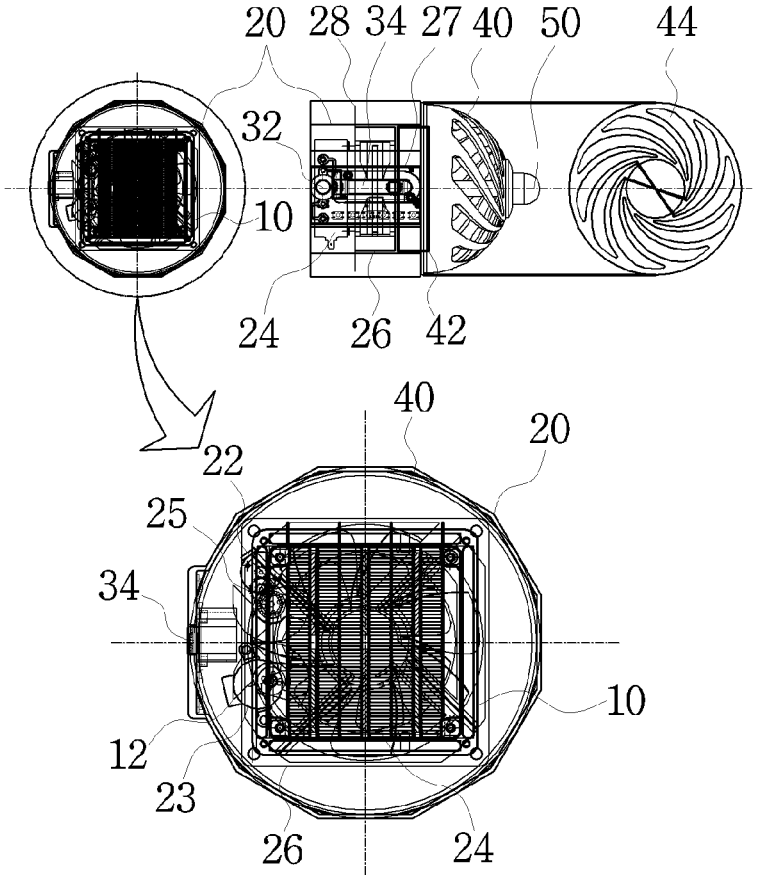
FIG. 4 is a view showing the arrangement of major components in a circular or polygonal support according to the present invention.

FIG. 4 shows cross-sectional views of the components received in the circular or polygonal support (20) of the multipurpose air controller (1) according to the present invention, wherein a side view is added in order to show the relation between the major components.

With reference to a side view of FIG. 4, the circular or polygonal support (20) includes, in the order of adjacency to the ventilation duct (10), drive motors (22, 23) and a reduction gear (25) in parallel to the heater (24), and the cooling fan (26) is arranged to its right side. The heater (24) and the cooling fan (26) are respectively fixed to fixing holes (not shown) in a steel plate of a second bracket (28).

At a right side of the cooling fan (26), an inner air filter (42) is arranged. Next, as means for completing the circular or polygonal support (20), a suction cap (40) formed with vortex design is secured by a handle (50), so that the arrangement and the alignment of the major parts are finished.

One of two circular or polygonal supports (20) included in the multipurpose air controller (1) of the present invention has a power on/off switch (32) and an LCD (34) for monitoring states of devices, wherein the power on/off switch (32) and the LCD (34) are longitudinally arranged on a lateral part of the circular or polygonal support (20). The control board (27) on which a series of control switches (36) is included at a lower part of the power on/off switch (32) and the LCD (34).

The lower portion of FIG. 4 shows a plane view of an inner side of the circular or polygonal support (20), wherein the cooling fan (26) covers most part of the heater (24) located at a center of the lower part, and the drive motors (22, 23) located at a left side. Also, since a blade end of the cooling fan (26) is slightly longer than the width of the heater (24), the relatively cool wind generated from the blade end flows through pores (103) formed between an outer skin (111) and an inner barrier (109) included in the ventilation duct (10). The relatively cool wind flowing through the pores (103) prevents hot air generated when driving the heater (24) from being directly transferred to the outer skin (111) of the ventilation duct (10) because the relatively cool wind discharges outside through ventilation holes (not shown) located midway. Accordingly, it prevents a user from being burned even when he touches the ventilation duct (10) while the multipurpose controller (1, 2) is operating.

As means for transmitting power to a semi-circle type-wind direction nozzle (12), FIG. 4 shows a smaller drive motor (22), which uses separate transmission gears (25), and a drive motor (23) which is equipped with transmission gears inside of the motor. Preferably, it is appropriate to employ the drive motor (23) equipped with gears inside thereof, in case of a multipurpose air controller (1) of the present invention using the circular or polygonal support (20). On the other hand, in case of a multipurpose air controller (2) using the tetragonal support (21), it is appropriate to use a smaller drive motor (22) with separate transmission gears (25). However, it is possible to select either drive motors depending on a design condition without any discrimination.

Also, the major components used in the multipurpose air controller (1, 2) of the present invention, such as the inner air filter (42), the cooling fan (26), the heater (24) and the drive motors (22, 23) can be readily disassemble or assembled in the order of stacking these components, after the suction cap (40, 41), which covers the tetragonal support (21) or the circular or polygonal support (20), is separated by releasing the suction cap fixing handle (50, 51).

Figure 5:
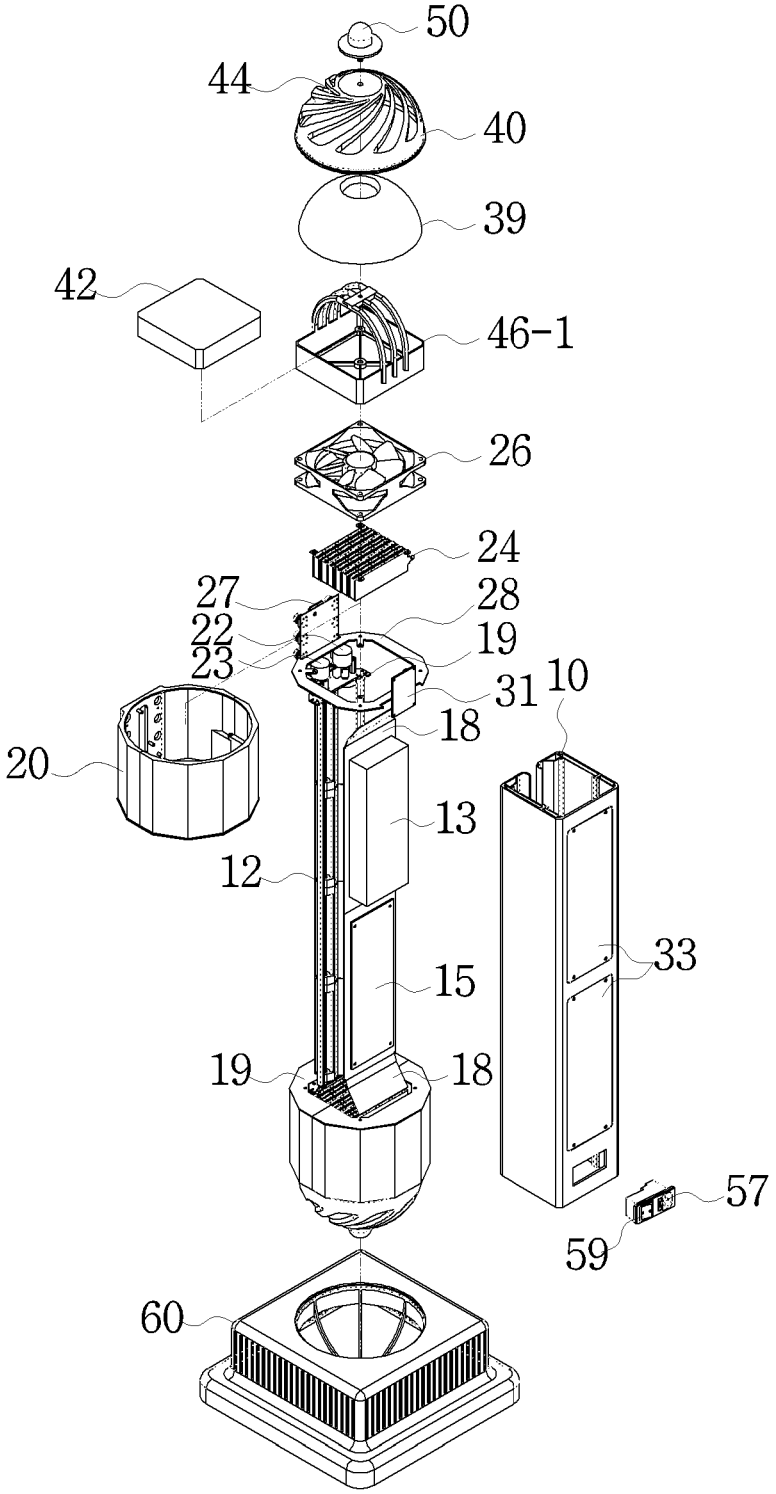
FIG. 5 is an exploded view of the multipurpose air controller according to the present invention.

FIG. 5 is an exploded perspective view of the multipurpose air controller according to the present invention, wherein all the components are arranged in the order of the assembly while it is assumed that the air controller is used in the upright position.

In FIG. 5, the prop (60) in the Gothic type, which is located at the bottom, is formed with a depression into which the suction cap (40) is placed. However, it is possible to employ the other prop (60) in the Eiffel Tower type.

In case that the prop (60) has the Eiffel Tower type, four sides of a base has been developed and distance between lower corners is long, so that it is possible to provide a stable prop (60).

The major components within the polygonal support (20) at the bottom are the same as those within the polygonal support (20) at the top, and thus, the major components within the polygonal support (20) at the bottom are not shown in a disassembled state in FIG. 5.

The ventilation duct (10) is coupled to the upper end of the polygonal support (20) at the bottom. The inside of the ventilation duct (10) is divided by a separation plate (18), wherein the separation plate at an opening of the ventilation duct forms an ramp toward a rear part of the ventilation duct (10), so that most of wind flowing from the cooling fan (26) is driven toward the semi-circle wind direction nozzle (12) so as to increase wind pressure, whereas only a portion of wind is driven toward the rear part of the ventilation duct (10) so as to use it for cooling the power source board (15) or a battery (or fuel cell)(13).

At a front opening of the ventilation duct (10), the semi circle wind direction nozzle (12) is located, wherein the semi circle wind direction nozzle (12) is connected to respective axes of the drive motors (22, 23) fixed to the first bracket (19) of the polygonal support (20). At a rear part of the ventilation duct (10), the power source board (15) and the battery (or the fuel cell) (13) are placed on a PCB support (not shown) projecting from the separation plate (18), wherein rear covers (33) of the ventilation duct are included at the positions that correspond to the power source board and the battery, respectively, for assembly and maintenance.

At a rear part of the ventilation duct (10), a power inlet (57) and a shut-down switch (59) are provided.

Being different from the polygonal support (20) at the bottom, the polygonal support (20) at the top includes the control board (27) and the wireless module (31) at a side in its interior.

A second bracket (28) is located at a center of inside of the polygonal support (20); the heater (24) is fixed to a lower face of the second bracket (28); and the cooling fan (26) is fixed to an upper face of the second bracket (28).

The filter and the suction cap support (46-1) are placed on an upper end of the cooling fan (26), and are fixed to the first bracket (28) through a fixing holes corresponding to the fixing holes formed at four corners of the cooling fan (26).

An inner air filter (42) is inserted in a space, which is formed within the filter and the suction cap support (46-1).

The suction cap (40) is fixed at a fixing hole by means of the suction cap fixing handle (50) which is located at the upper end of the filter and the suction cap support (46-1), while an outer air filter (39) is inserted in a lower end of the suction cap (40).

The outer air filter (39) is used for collecting coarse dust flowing from outside, while the inner air filter (42) is used for collecting fine dust, so that any proper dust filter may be mounted according to its purpose.

Figure 6:
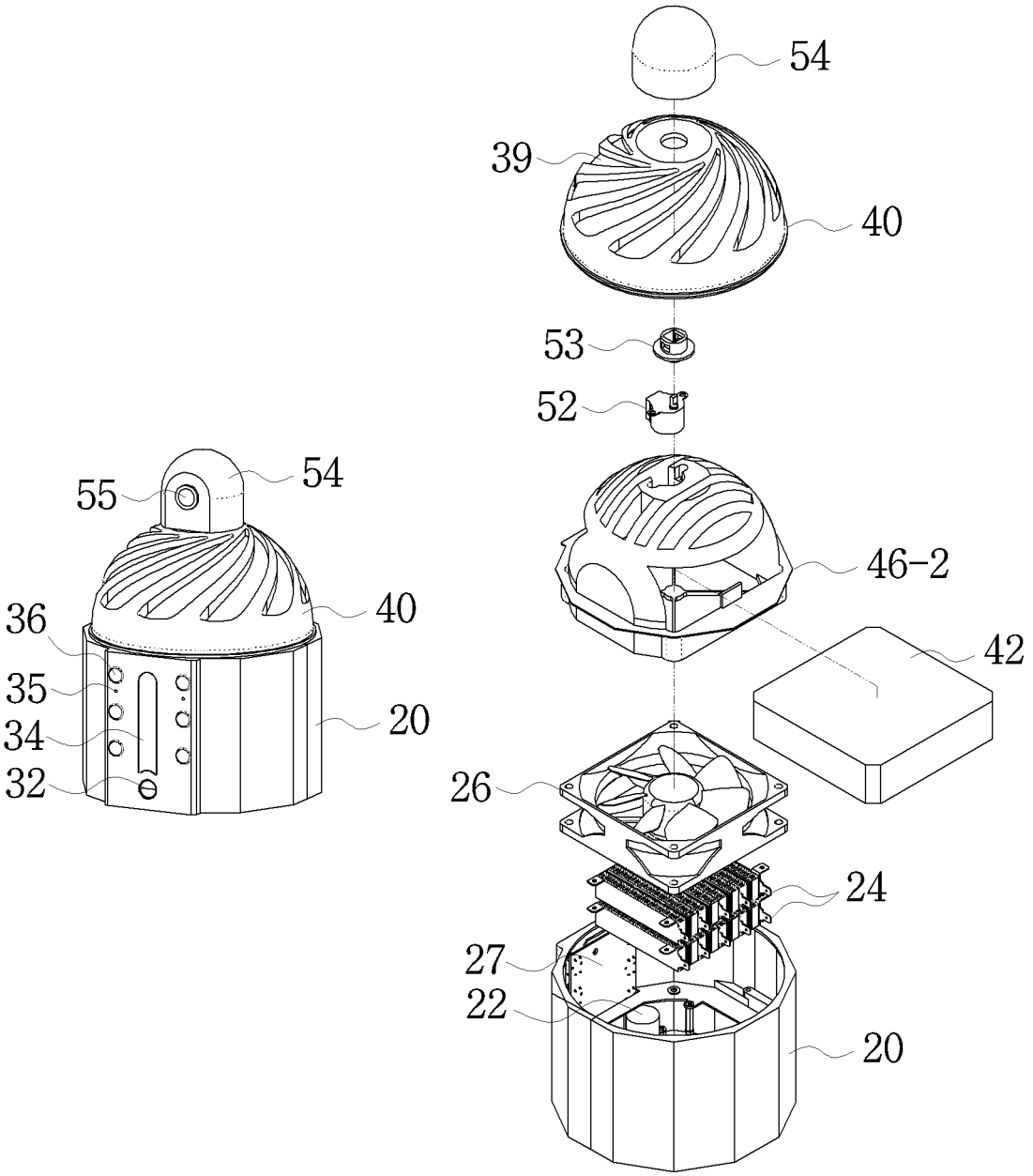
FIG. 6 is an exploded view of a camera module replacing a suction cap fixing handle.

FIG. 6 shows a camera module (54) at the top of the polygonal support (20), which replaces the fixing handle (50) of the suction cap (40). A lens (55) of the camera (not shown) embedded in a vertical face is exposed at a side in a vertical direction.

The camera module (54) is connected to an axis of a motor for rotating the camera module fitted through the upper end of the filter and suction cap support (46-2). Also, the camera module is coupled to a rotation axis support (53) projecting above the suction cap (40), while the suction cap (40) is secured not to be on the loose.

The structure under the filter and suction cap support (46-2) in FIG. 6 is the same as that in FIG. 5. However, the heaters (24) under the cooling fan (26) are stacked so as to increase a heating capacity, so that FIG. 6 shows two layers of the heaters. Otherwise, a single layer of the heater (24) is possible as necessary.

The drive motors (22, 23) are arranged under the heater, wherein the drive motors are paired at right and left sides, so as to drive the semicircular wind direction nozzles (12).

The power switch (32), the LCD (34), the LED (35) and the control switch (36) are outwardly protruded from the control board (27).

In FIG. 6, two LEDs are provided besides the control switch (36) which is located adjacent the suction cap (40). One of the LEDs is used as means for displaying CROSS/SYNC, i.e., indicating whether the paired semicircular wind direction nozzles (12) are crossed in their drive directions or they concurrently operate in the same direction. The other of the LEDs is used as means for indicating whether the semicircular wind direction nozzles (12) are in a rotation state or a stop state.

Further specific descriptions will be given below with reference to a block diagram in FIG. 9.

Figure 7:
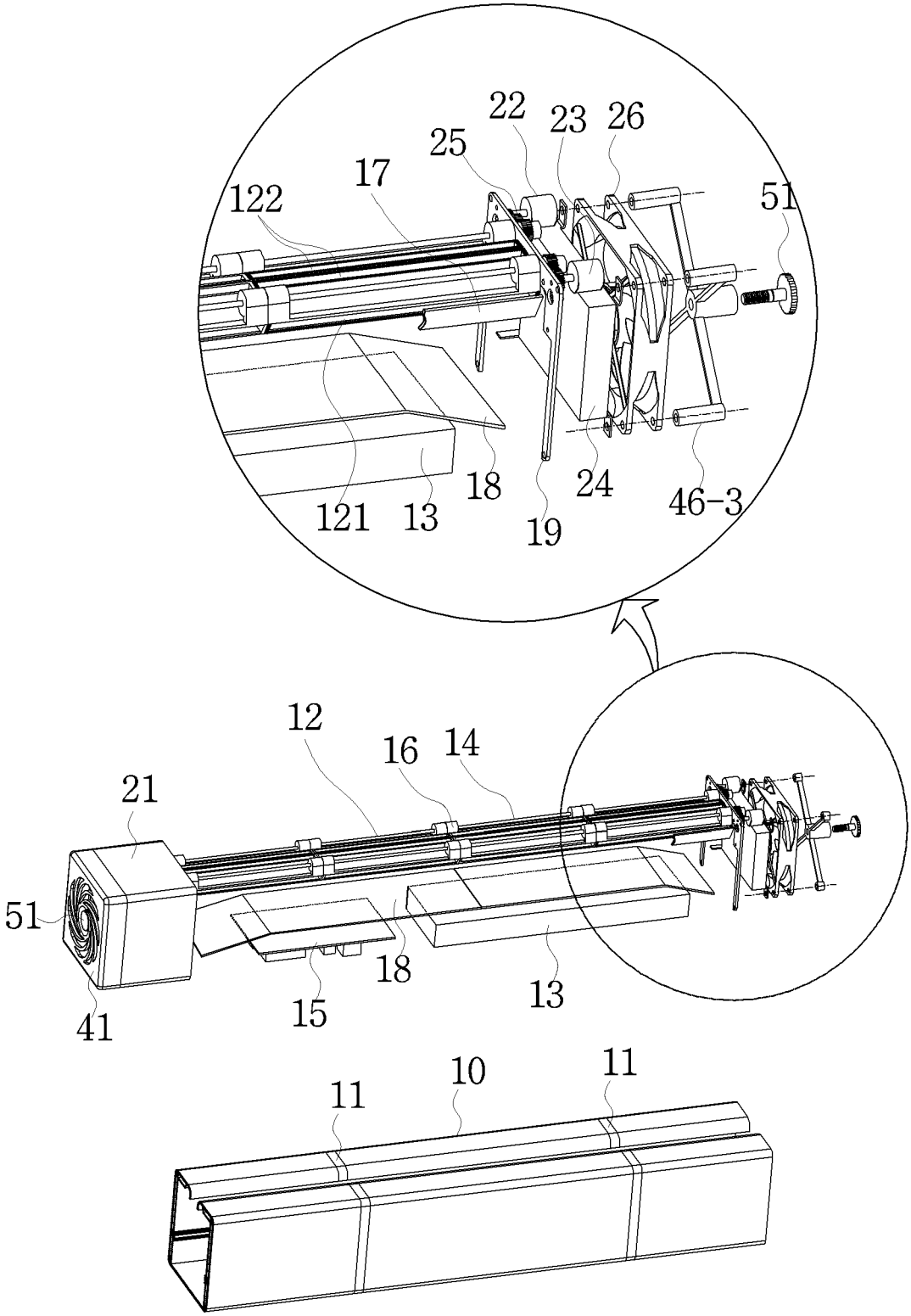
FIG. 7 is an exploded view of another multipurpose air controller according to the present invention.

FIG. 7 is an exploded perspective view of another multipurpose air controller (2), wherein the relationship between the major components mentioned above and the connection/arrangement of the other components for configuring the present invention are illustrated.

The ventilation duct (10) is formed by means of drawing or extrusion and has a cuboid shape, wherein one of its surfaces opens at a center. Further description for the cross-section of the ventilation duct will be given below with reference to FIG. 8.

Additional rectangular hole is provided on a rear surface of the ventilation duct (10) so as to fit the power input fixture (57) and the power shutdown switch (59).

Also, a series of exhaust holes (not shown) are provided at the rear surface of the ventilation duct (10) in order to let the heat from the power module (15), which is equipped in the ventilation duct, flow by relatively cool wind from the cooling fan (26).

Referring to FIG. 7, an axis (14) of the wind direction nozzle is inserted in a through-hole (not shown) formed in the rotation axis guide (16) at an end of a unitary wind direction nozzle (12) and a plurality of the wind direction nozzles (12) are assembled at right and left sides, so that the semicircular wind direction nozzle (12) is attained. Here, a length of the ventilation duct is determined depending on the number of the unitary semicircular wind direction nozzles (24) to be assembled. Accordingly, an air-discharging area of the semicircular wind direction nozzles (12) may increase or decrease as a whole, and thus, the cooling fan (26) may be changed in its exterior size, a fan thickness and a pitch thereby.

The rotational axis (14) of the wind direction nozzle, which projects from the end of the assembled semicircular wind direction nozzle (12), is connected to the drive motor (22) through the reduction gear (25) by passing the first bracket. Otherwise, it is directly connected to the drive motor (23) through separate connecting means (not shown).

Although not shown in FIG. 7, the drive motors (22, 23) have separate protecting brackets and fixing holes (not shown) on a surface of the rotational axis, so that the direct connection to the first bracket (19) is achieved and that the first bracket (19) is connected to a connection hole (101) in the ventilation duct (10). Thereby, it is possible to secure the semicircular wind direction nozzle (12) within the ventilation duct (10), while the ventilation holes (122) facing outward.

A blocking plate (17) of the wind direction nozzle is provided at an inlet of the suction hole (121) of the semicircular wind nozzle (12), wherein the blocking plate (17) may open or close the suction hole (121) in a state that the wind direction nozzles (12) are inwardly drawn by means of the drive motors (22, 23).

In FIG. 7, only a part of the blocking plate (17) of the wind direction nozzle is shown so as not to block all the suction hole (121) of the semicircular wind direction nozzles (12). However, the blocking plate (17) of the wind direction nozzle has the same length as the semicircular wind direction nozzle (12) and either end of the blocking plate (17) is fitted to holes (not shown) of the first bracket (10) to be rigidly secured with the semicircular wind direction (12). An axis of the blocking plate (17) is coupled to and driven by separate drive motor, a solenoid or a simple mechanical lever projecting outward for driving the blocking plate, which is located in parallel with the heater (24) at another first bracket (19) opposite to the first bracket (19) to which drive motors (21, 22) for driving the semicircular wind direction nozzles (12) is coupled.

Referring to FIG. 7, a separation plate (18) shown below the semi-circular wind direction nozzle (12) is inserted from an end of the ventilation duct into the ventilation duct (10) along a guide grooves (105) included on an inside of the ventilation duct. A terminal edge of the separation plate (18) is designed to meet an outer edge of the heater (24), so that hot air passing the corrugated heat sink (245) of the heater (24) is further compressed by wind pressure of the cooling fan (26). At the same time, the separation plate (18) serves to allow cool air generated from a blade end of the cooling fan (26) to flow toward an underside of the separation plate (18) where the power board (15) is placed, without passing the heater (24). Accordingly, air flow with the high temperature and the high pressure passes above the separation plate (18) where the semicircular wind direction nozzle (12), whereas air flow with the room temperature and the low pressure passes below the separation plate (18).

Due to a higher pressure, regardless of a rotational position of the semicircular wind direction nozzle (12), if suction inlets (121) of the semicircular wind direction nozzles (12) are open by the cover plate (17), air stream above the separation plate (18) flows along an outlet forming a curved surface of the semicircular wind direction nozzle (12) through the suction inlets (121) and is discharged through the exhaust holes (122). Under the separation plate (18), slow air stream causes hot air generated from the power source board (15) to be discharged through a series of the exhaust holes (not shown) formed on the rear side of the ventilation duct (10).

The heater (24) and the cooling fan (26) are respectively fixed to fixing holes (not shown) of the second bracket (28), wherein the heater (24) is arranged side by side with the drive motors (22, 23) fixed to the first bracket (19) as shown in FIG. 4, the cooling fan (26) is arranged outside of the heater (24) and an outer side of the second bracket (28) is coupled to the tetragonal support (21) or the circular or polygonal support (20).

An inner air filter (42) is provided outside of the cooling fan (26), wherein the inner air filter (42) is used by adapting it to the shape of the filter and suction cap support (46-3) shown in FIG. 7. The inner air filter (42) has the same exterior size as the cooling fan (26) and it is formed with round type-four corners.

The inner air filter (42) having above-mentioned configuration is applied to the cooling fan, while fitting its corners to round type-fixing axes of the filter and suction cap support (46). The inner air filter is secured by fixing the filter and suction cap support (46) in correspondence to four corners of the cooling fan (26).

However, the fixation of the inner air filter (46) using the filter and suction cap support (46-3) in FIG. 7 makes the replacement of the inner filter (46) uneasy, because screws for fixing the filter/suction cap support (46) at four corners should be removed whenever the air filter is replaced.

As a way of solving this problem, it needs a different shape of the filter/suction cap supports (46-1, 46-2), which has the shape formed by reversing the filter/suction cap supports (46-1, 46-2) shown in FIG. 5 or 6. Here, ribs branched off to four axes face the cooling fan (26), and a round type-axis corresponding to a central branching point is flush with the ribs.

Also, four fixing axes of the filter/suction support (46-3), which has been fixed by being coincident with the corners of the cooling fan (26), extends in their lengths so as to be coincident with a lower surface of the cooling fan (26), but these fixing axes are not inserted into the fixing holes of the cooling fan (26). Rather, the second bracket (28) is provided with other fixing holes (not shown) for fixation of the fixing axes, wherein such fixing holes are arranged on the second bracket (28) to allow the fixation in a rotated state by an angle of 45 degree.

By doing so, the inner air filter (42) is inserted in the outside of the filter/suction support (46-3) with the size coincident with that of the cooling fan (26).

Also, the round type-ribs, which are branched off to the outside of the filter/suction cap support (46-3), are branched off to left/right direction and are connected at a center. Like the above-described filter/suction cap support (46), there is provided with a fixing hole at a center, which corresponds to the suction cap handle (51).

In the filter/suction cap support (46-1, 46-2) respectively having the new shape, the round type-ribs, which are branched off to the outside and then gathered to the center, include an elastic spring plate (not shown) in a thin plate form for pressing the inner air filter (42). Accordingly, the air filter (42) can be inserted or withdrawn in a sliding manner through a rib-free side space, without separating all the filter/suction cap support (46-1, 46-2). Thus, the convenience for replacing the air filter (42) is provided.

On a side surface of the air filter (42), a reflection tape (not shown) for distinguishing a type of the air filter (42) is provided. Also, on the control board (27), a sensor for detecting the presence of the air filter (42) and the type of the air filter (42) is provided, which comprises a LED and a photo transistor (not shown).

Figure 8:
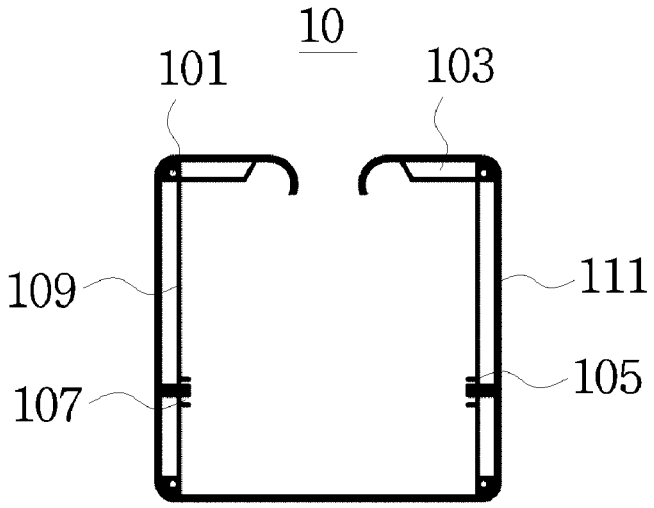
FIG. 8 is a cross-sectional view of a ventilation duct with an inner barrier according to the present invention.

FIG. 8 is a cross-sectional view of the ventilation duct (10) of the present invention, which comprise an inner barrier.

As described above, the ventilation duct (10) has a single hollow space through its length, wherein it is provided with the guide grooves (105) for receiving the separation plate (18), which divides the hollow space into the hot air stream space and the room temperature air stream space.

Below the guide grooves (105) for receiving the separation plate, other guide grooves (107) for receiving the power source board (15) are formed.

Also, the ventilation duct (10) used in the multipurpose air controllers (1, 2) of the present invention is provided with inner barriers (109) on right/left side walls and opening, so that cavities (103) are provided there-between.

Room temperature-wind generated from the blade end of the cooling fan (26) flows through the cavities (103), so that a phenomenon of heat transfer to the skin (111) due to the hot air stream flowing above the separation plate (18) within the ventilation duct (10) may be cancelled.

Also, thermo-sensitive color display means (11), such as thermo-sensitive tape or paint that changes in its color according to temperature of the ventilation duct is provided around the outer wall of the ventilation duct (10). Accordingly, the user might directly discern the thermal state or a hottest spot of the ventilation duct in the distance, without directly confirming text-displayed temperature on the LCD (34). Thereby, the user can verify the operational state of the air controller from the outside and can be guided to grab a non-heated part.

When manufacturing the ventilation duct (10) in FIG. 8 by drawing or extruding aluminum material or heat resistant engineering plastic material (PPS), it might be difficult to process distances of the openings within a certain tolerance. In such a case, the process is performed in such a way that a thinnest possible-connecting plate is used to connect plates forming a shortest distance between the openings. Afterward, the connecting plate between the openings that has been intentionally attached is removed. Accordingly, it is possible to attain the ventilation duct (10) having an intended cross-section shown in FIG. 8, while maintaining a precision.

Figure 9:
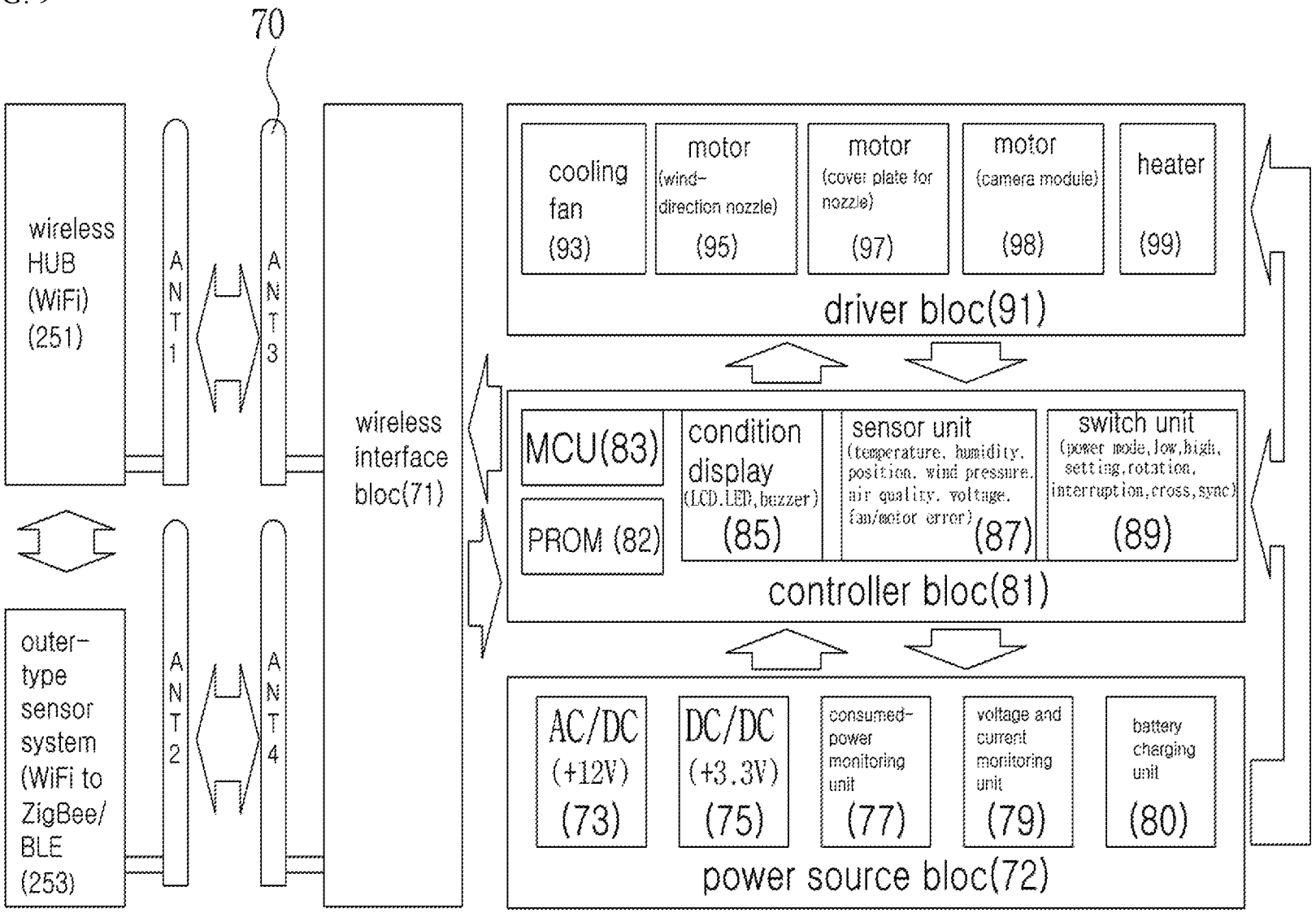
FIG. 9 is a block diagram according to the present invention.

FIG. 9 is a bloc diagram showing operation of the multipurpose air controller (1, 2) of the present invention, wherein the main body comprises four major blocks including a power source bloc (72), a controller bloc (81), a driver bloc (91) and a wireless interface bloc (71), and the external device for interfacing with the main body comprises a wireless hub (251) and an external sensor system (253).

The power source bloc (72) comprises an AC/DC converter unit (73), a DC/DC converter unit (75), a consumed power monitoring unit (77), and a voltage/current monitoring unit (79), which are mounted to the power source board (15) in FIG. 6.

The AC/DC converter unit (73) receives the external AC input power, which is connected thorough a power inlet (not shown) on a rear part of the ventilation duct (10), and generates the DC power needed in the multipurpose air controller (1, 2) of the present invention through a full wave rectification and smoothing circuit.

The DC power generated through the AC/DC converter unit (73) may be +12 V or +24 V according to the DC input voltage inputted to the cooling fan (26) or the drive motors (22, 23).

The DC/DC converter unit (75) uses the DC voltage generated through the AC/DC converter unit (73) as an input voltage to thereby generates lower voltage-DC power suitable for driving a logic circuit in the controller, wherein it mainly generates the power with +3.3 V or +5 V.

The consumed power monitoring unit (77) serves to monitor the power consumed in a standby state or in a state of using the multipurpose air controller (1, 2) of the present invention. The voltage and the current of the AC inlet line inputted to the AC/DC converter unit (73) are monitored in real time using a dedicated IC device. Afterward, real time power consumption is calculated based on the monitoring and resultant value is transmitted to a micro controller unit (83) in the controller (81) in a serial transmission, such as 12C interface or it is converted and outputted as the DC voltage in real time from a designated output pin of a dedicated IC device. Then, it is transmitted in a way of connection to an ADC (Analog to Digital Converter) port of the MCU (83).

The voltage/current monitoring unit (79) is means for monitoring output voltage and current of the power source bloc (72), wherein the voltage outputted through the full wave rectifier is linked to a photo coupler to be connected with the ADC input pin of the MCU (83) on the control block (81). By monitoring the voltage inputted to the ADC pin in the MCU (83) of the control bloc (81), it is served as a reference point for performing such operation as application of the AC voltage to the heater (24) or shutoff of the same at a Zero-Crossed Detect (ZCD) where the AC voltage inputted with an arbitrary frequency, such as 50 Hz or 60 Hz becomes zero.

In order to monitor current of the inputted AC power, the current may be measured by detecting the voltage outputted from coils, which has a predetermined turns ratio, using the ADC port on the MCU (83) of the control bloc (81).

With the use of the external AC input voltage and its current grasped by the above-described means, they are used as the real time data in order not to exceed a rated drive condition of the heater (24) for an arbitrary AC input voltage.

The control bloc (81) comprises the MCU (83), a state display unit (85), a sensor unit (87) and a switch unit (89).

A PROM (82) is a programmable memory, while it is a non-volatile memory capable of re-programming like a EEPROM or flash Prom, wherein the user can control the PROM through the switching unit (89) or can store each register information transmitted from the wireless interface bloc (71).

The MCU (83) is connected to the state display unit (85), the sensor unit (87), the switch unit (89), the consumed power monitoring unit (77) and the voltage/current monitoring unit (79) of the power source bloc (72) so as to monitor respective state. Also, the MCU (83) outputs state-information on the state display unit (85) and performs respective control for the units in the drive bloc (91).

In addition, the MCU (83) is connected to the wireless interface bloc (71), so that it is possible to remotely power-on/power off the multipurpose air controller (1, 2) or to performs respective control, such as wind direction control, temperature control, duration control, etc.

Particularly, if the MCU (83) determines that the air filter (42) mounted in the multipurpose air controller (1, 2) of the present invention is a common air filter for removing dust, rather than a dedicated air filter having a higher density for air purification, and that an auto-cleaning function is set to be in effect, an Initial operation is carried out whenever the power is on. Specifically, the wind direction cover plate (17) blocks the suction holes (121) on the inner face of the wind direction nozzle (12) in a state that the wind direction nozzle (12) completely moves inward, and then the fan at a side rotates strongly to thereby blow dust on the heater (24), the cooling fan (26) and the air filter (42) outward. Afterward, the operation of the cooling fan (26) at a side is terminated, and then the cooling fan at the other side rotates strongly to thereby blow dust on the heater (24), the cooling fan (26) and the air filter (42), all of which are located opposite side, outward. After completing such auto-cleaning function, the other operation may be performed according to a setting state of a register, which was previously stored in the PROM (82).

The auto-cleaning function may be performed while the multipurpose air controller of the present invention is being used, in addition to the initial operation. Specifically, if the MCU (83) monitors that power is excessively consumed due to dust stacked between electrodes of the heater, the auto-cleaning function is performed to thereby reduce unnecessary consumption of power and extend service life of heater.

The state display unit (85) displays variety of states information about the multipurpose air controller (1,2) of the present invention on the LCD using text or symbols. Also, it is possible to display variety of states information or setting information through light or sound by means of the LED or the buzzer.

The sensor unit (87) may comprise a temperature sensor, a humidity sensor, a wind pressure sensor, a position sensor, and etc. The temperature sensor (not shown) may be installed in the vicinity of a suction inlet of the cooling fan (26) on the control board (27), to thereby sense intake air temperature. The other temperature sensors (not shown) may be installed between the heater (24) and the first bracket (19) and in the vicinity of the wind direction nozzle inlet in the ventilation duct (10), so that it may sense the temperatures thereat when the heater (24) is operating.

The humidity sensor (not shown) is installed adjacent to the temperature sensor in the vicinity of the suction inlet of the cooling fan (26) on the control board (27). Otherwise, the temperature sensor may be replaced with an integral sensor for sensing temperature and humidity.

If the multipurpose air controller (12) of the present invention is used for drying laundry, the humidity sensor (not shown) monitors reduction in humidity as the laundry dries, so that it is controlled to stop the operation of the heater (24) or the operation of the heater (24) and the cooling fan (26).

The position sensor (not shown) is used to indicate a current position where the multipurpose air controller (1,2) of the present invention is placed. When the air controller is placed on a floor, the MCU (83) recognizes the current state. Thereafter, If the situation under which a range of inclination for the position sensor (not shown) is exceeded occurs, the MCU (83) regards the air controller as being tumbled and terminates all the operation of the air controller. Such is different from a way of sensing overturn of a common heater, wherein the common heater has a switch projecting from a bottom surface to thereby sense tumbling of the heater.

The switch unit (89) is provided for operating the multipurpose air controller (1, 2) of the present invention, which comprises: a power on/off switch; a mode switch for designating air volume of wind (cooling fan)/temperature (heater)/wind direction (wind direction nozzle, deviation angle)/location of placement, auto-cleaning function, etc.; a high/low adjustment switch for adjusting high/low for a designated item of the mode switch; a set switch for setting a designated mode or high/low; a rotation/non-rotation switch for the wind direction nozzle (12); a CROSS/SYNC switch for crossing the operational directions of two wind direction nozzles or for directing two wind direction nozzles to the same direction.

The drive bloc (91) comprises a cooling fan (93), a wind direction nozzle drive motor (95), a drive motor (97) for the cover plate of the wind direction nozzle and a heater (99).

Since a control voltage outputted from the MCU (83) is different from drive voltages for the components in the drive bloc (91), dedicated semiconductor devices are used for driving the components in the drive bloc (91).

If the cooling fan (26) or the drive motors (22, 23) uses +12 V, it is possible to attain the same thorough FET or IC for driving the motor and the peripheral circuit design. However, in case of the heater (24) supplied with AC power, it is preferred to use TRIAC as a major driving unit for the heater driving bloc (99).

The wireless interface bloc (71) comprises at least one or more antenna in correspondent with type of external interface. Also, wireless standard like a Wi-Fi, a Zigbee or a Bluetooth may be supported according to a type of an IC for an embedded RF.

A digital signal inputted to or outputted from the IC for the RF is transmitted to the MCU (83).

In accordance with a setting condition, the wireless interface bloc (71) provides direct interface between the external wireless HUB (251), which is of the WiFi interface standard, and a wireless module embedded with the RF IC for the WiFi. Otherwise, it provides the WiFi interface between the wireless HUB (251) and the external sensor system (253) and the ZigBee interface or the Bluetooth interface between the external sensor system (253) and the wireless interface bloc (71).

Particularly, the external sensor system (253) comprises sensors (not shown) like a temperature/humidity sensor and air-quality sensor, so that when the user posses the external sensor system (253) or the user lays the external sensor system (253) at the position where he stays, the detection results of the temperature/humidity sensor or the air-quality sensor are transmitted to the MCU (83) of the multipurpose air controller (1, 2) through the wireless interface unit (71). Accordingly, the user's position oriented operation can be achieved.

In the case of a common heater, automatic temperature control is performed according to temperature detected from a body of the heater. In the case of the multipurpose air controller (1, 2) of the present invention, although it is possible to perform the automatic temperature control based on a main body of the air controller, if the external sensor system (253) being used is detected and if the external sensor system (253) is set to have a priority in operation, it is possible to operate the air controller according to the user's designated position, which is transmitted from the external sensor system (253) disposed away from the main body of the multipurpose air controller (1, 2).

The MCU (83) stores data outputted from the wireless interface bloc (71) in an inner register and performs the operation according to bits stored and set in the register, while reflecting all the items operated in the switch unit (89).

Particularly, in the multipurpose air controller (1, 2) of the present invention, values of detected conditions sensed by the sensors of the external sensor system (253) are shared as the set values in the register of the MCU (83) between a plurality of the air controllers through the wireless interface bloc (71) using the transmission-reception antenna. Here, the position information regarding the wind direction nozzles (12) is shared between the air controllers, so that it is possible for the wind direction nozzles (12) to be oriented in the same direction, although they are physically away from each other. Accordingly, it is possible to increase the strength of wind discharged from the wind direction nozzle (12).

In addition, the multipurpose air controller (1, 2) of the present invention may be mounted to a multi-step rack in a series and the wind direction nozzle (12) may be operated as described below with the increased capacity (wind power, temperate).

First, the multipurpose air controller (1, 2), whose wind direction nozzle (12) serves as a master while in rotational operation, shares the set condition with other multipurpose air controllers, whose wind direction nozzles serve as a slave. When the wind direction nozzle (12) is set to be in the CROSS mode and in the rotational condition, the suction hole (121) of the wind direction nozzle (12) moved inward is covered with the cover plate (17). Thus, the wind is not discharged in a vertical direction of the air controller, and the wind is discharged only in a horizontal direction of the wind direction nozzle (12) projecting outward. Accordingly, the wind flows from the adjacent air controllers in the same direction, so that the strength of wind can be increases as much as the number of the air controllers.

In the multipurpose air controller (1, 2) of the present invention, the heating plate serving as the PTC heating device and the electrode are described as the heater with reference to FIG. 3. If the heater (24) based on the PTC heating device, the PTC heating device represents low resistance in a normal temperature due to its characteristics. Accordingly, a household circuit breaker may be turned off, because rush current tends to flow to the PTC heating device when turning on the power.

In order to avoid this phenomenon, three ways may be respectively used or three ways may be mixed with each other as described below.

As a first way, the PTC heater (24) partially operates in a certain period of time through the electrode (243) serving as the heat sink (245) made of aluminum material. As a result, the temperature of the PTC device (249) increases in a certain degree, so that it causes increase the resistance of the PTC device.

A preferred way of partially operating the PTC heater (24) is to operate P1 and P2 of the electrodes (234) in a certain period of time. Afterward, P2 and P3 are operated in a certain period of time, while the operation of P1 is interrupted. Thereafter, P3 and P4 are operated in a certain period of time, while the operation of P2 is interrupted. By means of such a circulation in operations, the temperature of the PTC device (249) coupled to each of the electrodes increases gradually.

As a second way, AC input voltage applied to the electrode of P1, P2, P3 and P4 connected to the PCT device (243) and gate voltage of the drive device, i. e., TRIAC are distinctively applied as voltage for warming operation and voltage for common operation. The output voltage of the TRIAC is outputted with a lower voltage, and then it is applied to each of the electrodes.

As a third way, voltage applied to each electrode is ON/OFF controlled in the PWM (Pulse Width Modulation) manner on the basis of the ZCD (Zero-Cross Detect) operation mentioned above.

Here, it is possible for the MCU (83) to define a period of time for the ON section where the power turns on and a period of time for the OFF section where the power turns off, wherein it lasts between about 100 milli-second (msec) and about 1 second. In a step of warming-up, the ON section where the power turns on is driven shortly. After the step of warming up, the ON section is driven for a long time.

In three ways of operation mentioned above, the period of time for the section of warming up operation may be stored in the MCU (83) in advance. However, since ambient temperature might be changed depending on the condition of the air controller, it is preferred that the warming up operation is switched to the common operation as soon as the temperature detected by the temperature sensor in the ventilation duct (10) is higher than a previously-set temperature in the register of the MCU (83), so that the safer operation of the PTC heater (24) is possible.

As described above, the preferred embodiments of the present invention have been described. However, it is apparent that one of ordinary skill in the art may envisage many variants and modifications within a scope of the claims.

The invention claimed is:

1. A multipurpose air controller, comprising:

a cooling fan;

a drive motor arranged adjacent to said cooling fan; and a ventilation duct including a semi-circular wind direction nozzle, wherein air inhaled by said cooling fan is discharged along a right-angled path through the semicircular wind direction nozzle connected to a drive shaft of said drive motor.

2. A multipurpose air controller as claimed in claim 1, further comprising a heating element arranged side by side with said drive motor.

3. A multipurpose air controller as claimed in claim 1, further comprising at least one or more circular or polygonal support, which includes said cooling fan and said drive motor therein.

4. A multipurpose air controller as claimed in claim 3, wherein said polygonal support comprises: a senor unit including a temperature sensor, a humidity sensor, a position sensor, a wind pressure sensor, etc.;

an input switch unit including a power switch and a limit switch;

a display including an LCD, LED and a buzzer;

a control signal unit including an on/off signal of the motor, the cooling fan and the power; and a control unit including a microcontroller connected to said sensor unit, said input switch unit, said display and said control signal unit.

5. A multipurpose air controller as claimed in claim 4, wherein said control unit performs operation in connection with ambient temperature, humidity, air volume of wind from the cooling fan, temperature of a heater, temperature inside the ventilation duct, an operational angle range of the wind direction nozzle, a timer setting value, a floor position, organized operation with an adjacent device, etc., based on a preset value or said control unit allows said operation based on a reset-value that is arbitrarily changed by a user.

6. A multipurpose air controller as claimed in claim 4, wherein said control unit further comprises a wireless input/output part.

7. A multipurpose air controller as claimed in claim 6, wherein said control unit controls a direction change between the wind direction nozzles of the adjacent multipurpose air controllers so as to attain mutual synchronization.

8. A multipurpose air controller as claimed in claim 7, wherein if said control unit detects that at least one or more multipurpose air controllers are included on a prop and if two semicircular wind direction nozzles are set to operate in the CROSS manner, the wind direction nozzle that has been moved inward is covered with the cover plate of the wind direction nozzle and only the projected wind direction nozzles of the adjacent multipurpose air controllers enable wind blowing, so that wind blows in the direction that is determined according to a vector principle.

9. A multipurpose air controller as claimed in claim 4, wherein if the control unit senses the power switch's turning-on and if an automatic cleaning mode is selected when turning on the power unit, the control unit controls the semicircular wind direction nozzles at either end of said ventilation duct to move inward to thereby cover the ventilation holes of the semicircular wind nozzles by means of the cover plate for wind direction nozzle, and then the control unit controls the cooling fan to be driven for a certain period of time so as to expel to the outside dusts on the heater, the drive motor, the cooling fan and the air filter positioned at an end, until the control unit controls the cooling fan to stop the operation and wherein the control unit controls the cooling fan positioned at opposite end to be driven for a certain period of time to thereby expel dusts on the heater, the drive motor, the cooling fan and the air filter at the other end, so that automatic cleaning operation is achieved.

10. A multipurpose air controller as claimed in claim 3, wherein if an arbitrary surface of said polygonal support lies on the floor, a position sensor of said control unit senses a direction of said wind direction nozzles from a placement angle of said polygonal support, and wherein if it is determined that the wind direction nozzles faces the floor, such state is displayed on a display and the corresponding wind direction nozzle moves inward and is covered with the cover plate for the wind direction nozzle so as to prevent wind discharge or said cooling fan or said heater is maintained in a stationary condition, so that a safe state is maintained.

11. A multipurpose air controller as claimed in claim 3, wherein said polygonal support is prevented from directly contacting the floor so as to avoid damage, and wherein said polygonal support has a circular rubber band tightly fitted around its periphery so as not to allow said polygonal support to slip on the floor, to thereby form a rubber-foot on said polygonal support.

12. A multipurpose air controller as claimed in claim 1, wherein said ventilation duct has an outer skin, which includes a structure of double barriers, and wherein wind flow generated from the outside of said cooling fan at room temperature is introduced between the double barriers, wherein said ventilation duct is formed with air vents in order to discharge wind flow Which was introduced between the double barriers.

13. A multipurpose air controller as claimed in claim 1, wherein said ventilation duct has at least one or more wind direction nozzles and wherein the wind direction nozzles are crossed with each other to operate in the CROSS manner or the wind direction nozzles operates in the SYNC manner without crossing with each other.

14. A multipurpose air controller as claimed in claim 1, wherein said ventilation duct comprise a cover plate for wind direction nozzles, so that air suction inlets of the wind direction nozzle are covered with the cover plate when the wind direction nozzle rotates inward to the maximum.

15. A multipurpose air controller as claimed in claim 1, wherein said multipurpose air controller includes at least one or more cooling fans at an end of the ventilation duct.

16. A multipurpose air controller as claimed in claim 15, wherein said multipurpose air controller includes at least one or more air filters outside of said cooling fans, wherein said multipurpose air controller further includes a suction cap/filter support, which serves to receive and support said air filters and which is formed with a suction cap fixing hole for fixing the suction cap.

17. A multipurpose air controller as claimed in claim 1, wherein said ventilation duct includes a power unit at an end opposite to an opening on which the wind direction nozzle is arranged, and wherein said ventilation duct includes slots for installing a barrier or a barrier for separating a space for the power unit and a space for the opening for the wind direction nozzle.

18. A multipurpose air controller as claimed in claim 1, wherein said semicircular wind direction nozzle is formed by coupling unitary semicircular wind direction nozzles which is capable of separating/coupling.

19. A multipurpose air controller as claimed in claim 1, wherein the cooling fan, the drive motor and the heating element are included on at least one or more side.

20. A multipurpose air controller as claimed in claim 1, wherein said ventilation duct or said semicircular wind direction nozzle has at least one or more means for indicating color change according to temperature change at its outside.

* * * * *